US005169353A

United States Patent [19]

Myers

[11] Patent Number: 5,169,353

[45] Date of Patent: Dec. 8, 1992

[54] MECHANISM AND METHOD FOR INTERLOCKING TWO NON-LATEX BALLOONS

[75] Inventor: David A. Myers, Minneapolis, Minn.

[73] Assignee: Anagram International, Inc., Minneapolis, Minn.

[21] Appl. No.: 683,308

[22] Filed: Apr. 10, 1991

[51] Int. Cl.[5] ..... A63H 3/06

[52] U.S. Cl. ..... 446/221; 446/223; 446/226; 446/901

[58] Field of Search ..... 446/221, 222, 223, 224, 446/225, 226, 220, 901

[56] References Cited

U.S. PATENT DOCUMENTS

| | | | |
|---|---|---|---|
| 1,858,460 | 5/1932 | Ranseen | 446/223 |
| 2,651,314 | 9/1953 | Hasselquist | 446/222 X |
| 2,753,658 | 7/1956 | Stickley | 446/223 |
| 2,952,094 | 9/1960 | Ebel | 446/221 |
| 3,108,396 | 10/1963 | Dorman | 446/901 X |
| 3,230,663 | 1/1966 | Shabram | 446/224 |
| 4,307,537 | 12/1981 | Bergmann | 446/222 |
| 4,778,431 | 10/1988 | Dudley | 446/221 |
| 4,976,649 | 12/1990 | Mandell | 446/222 X |
| 4,983,138 | 1/1991 | McGrath | 446/224 |
| 5,021,022 | 6/1991 | Ganz | 446/222 X |

*Primary Examiner*—David M. Muir

*Attorney, Agent, or Firm*—Allegretti & Witcoff, Ltd.

[57] ABSTRACT

The present invention relates to an interconnection between two non-latex balloons. The stem of one balloon engages a slot in the periphery of the other, and the ballons are then secured in a predetermined orientation.

28 Claims, 2 Drawing Sheets

MECHANISM AND METHOD FOR INTERLOCKING TWO NON-LATEX BALLOONS

BACKGROUND OF THE INVENTION

The present invention relates generally to inflatable non-latex balloon products and more particularly to a mechanism and method for attaching two non-latex balloons.

The popularity of inflatable non-latex balloons has grown steadily since the early 1970's. Recently, more complex products have evolved, including multiple balloons and accordion-like appendages to give a human or animal appearance. A number of such products are shown in U.S. Pat. No. 4,778,431, and the teachings thereof are incorporated herein by reference.

SUMMARY OF INVENTION

In a particular aspect, the present invention relates to a mechanism and method for attaching one non-latex balloon to a second non-latex balloon. When compared to the labor-intensive prior art, the present invention yields a simpler, quicker and less expensive interconnection between balloons.

The present invention involves the provision of a stem on one balloon and the provision of a boundary slot on the other. The stem may define the inflation passageway of the first non-latex balloon.

The boundary slot of the second non-latex balloon is adapted to receive the stem and to establish a predetermined orientation between the two balloons. The engagement of the stem with the slot is secured, thereby interlocking the two balloons.

It is thus an object of the present invention to provide a quick and simple mechanism and method for interlocking two non-latex balloons. It is also an object to provide a balloon interlocking mechanism such that multi-balloon products can be inexpensively manufactured, inflated and assembled.

These and other features, objects and advantages of the present invention are set forth or implicit in the following detailed description.

BRIEF DESCRIPTION OF THE DRAWING

Preferred embodiments of the present invention are described, in detail, herein with reference to the drawing wherein.

DETAILED DESCRIPTION OF PREFERRED EMBODIMENTS

Figure 1:
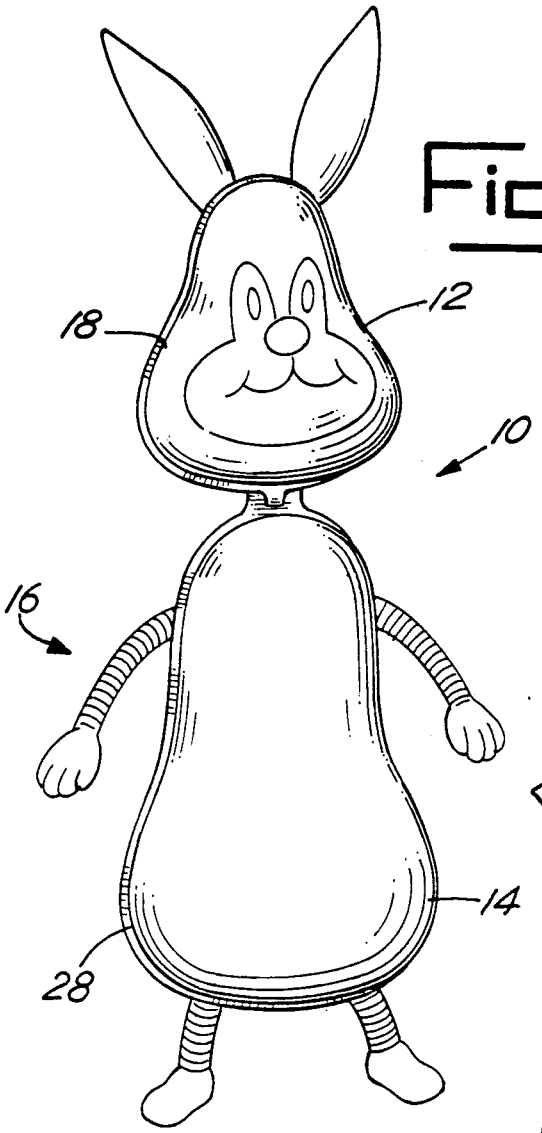
FIG. 1 is a front view of a two-balloon product including the present invention.
Figure 2:
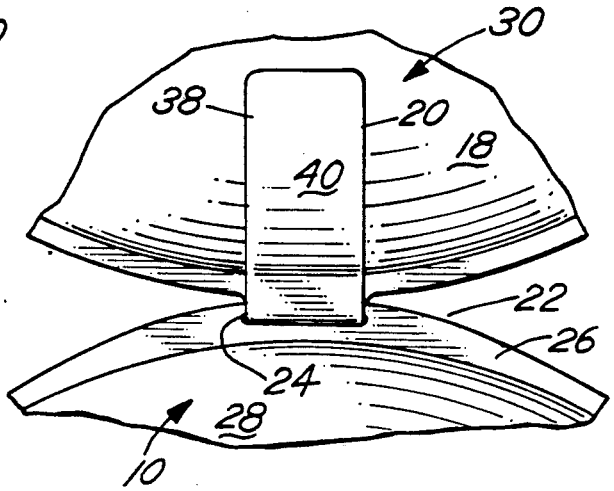
FIG. 2 is an enlarged partial back view of the present invention shown in FIG. 1.
Figure 3:
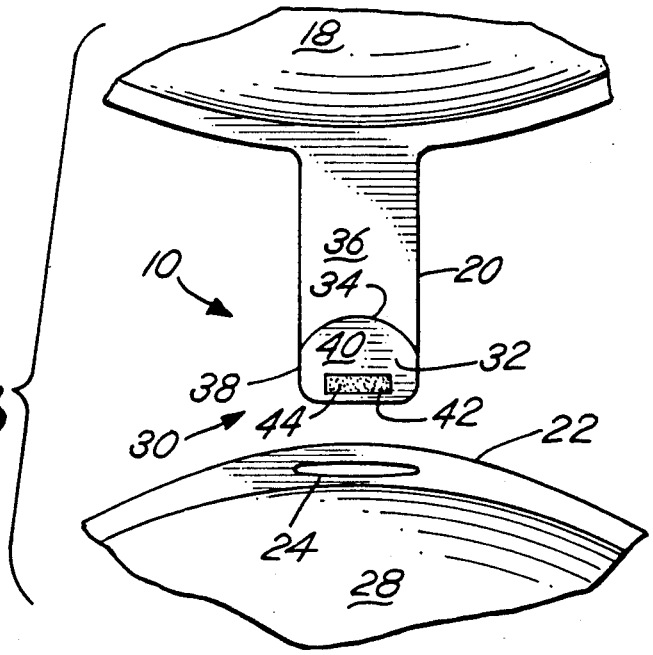
FIG. 3 is an enlarged partial back view of the preferred embodiment shown in FIG. 1, prior to interlocking of the balloons.

Referring to FIGS. 1–3, a first preferred embodiment of the present invention is shown as an interlock means, generally designated 10, for attaching a first inflatable non-latex balloon 12 to a second inflatable non-latex balloon 14. The balloons 12, 14 and various attachments, generally designated 16, provide a toy product having a rabbit-like appearance.

The first balloon 12 includes a body 18 having the desired configuration. The balloon 12 is provided with a substantially rectangular stem 20, extending from the body 18, and in this preferred embodiment, the stem 20 is the inflation stem. Preferably a self-sealing valve (not shown) is positioned within the stem 20. One such valve is described in U.S. Pat. No. 4,917,646, and the teachings thereof are incorporated herein by reference.

The second balloon 14 is provided with boundary enlargement 22, defining a slot 24 adapted to receive the stem 20 of the first balloon 12. As best shown in FIG. 3, the boundary enlargement 22 is preferably a slight outward extension of the heat-seal boundary 26 which defines the body 28 of the second balloon 14. The slot 24 is punched as the second balloon 14 is formed by a cutting die (not shown).

The interlock means 10 further includes securement means, generally designated 30. Once the stem 20 engages the slot 24, the securement means 30 secures the engagement and interlocks the balloons 12, 14. In this preferred embodiment, the stem 20 is folded back onto and adhered to the body 18 of the first balloon 12.

As best shown in FIG. 3, the stem 20 includes an inflation aperture 32, defined by a semicircular cut 34 in the back balloon web or sheet 36 at the end 38 of the stem 20. An inflation nozzle (not shown) is slipped through the inflation aperture 32, between the balloon sheets 36, 40, to fill the balloon 12 with a fluid, such as helium.

In this preferred embodiment, the securement means 30 is positioned in the inflation aperture 32 and more particularly on the front balloon web 40 near the end 38. The securement means 30 secures the end 38 to the body 18, thereby "hiding" the inflation aperture 32 and providing a pleasing appearance.

The securement means 30 includes a segment of double-sided tape 42 having a removable protective sheet 44. In the preferred method, the first balloon 12 is inflated and the stem 20 is inserted through the slot 24. The protective sheet 44 is removed and the stem 20 is folded into contact with and adhered to the body 18 of the first balloon 12. Inflation may occur after engagement of the stem 20 with the slot 24.

The securement means 30 is most preferably releasable such that the first balloon 12 can be re-inflated when necessary. In this preferred embodiment, the surface of the double-sided tape segment 42 covered by the protective sheet 44 carries a releasable adhesive. This releasability allows the stem 20 to be detached from the body 18 for addition of helium. The securement means 30 may alternatively be two "Velcro" strips appropriately positioned on the toy product.

Figure 4:
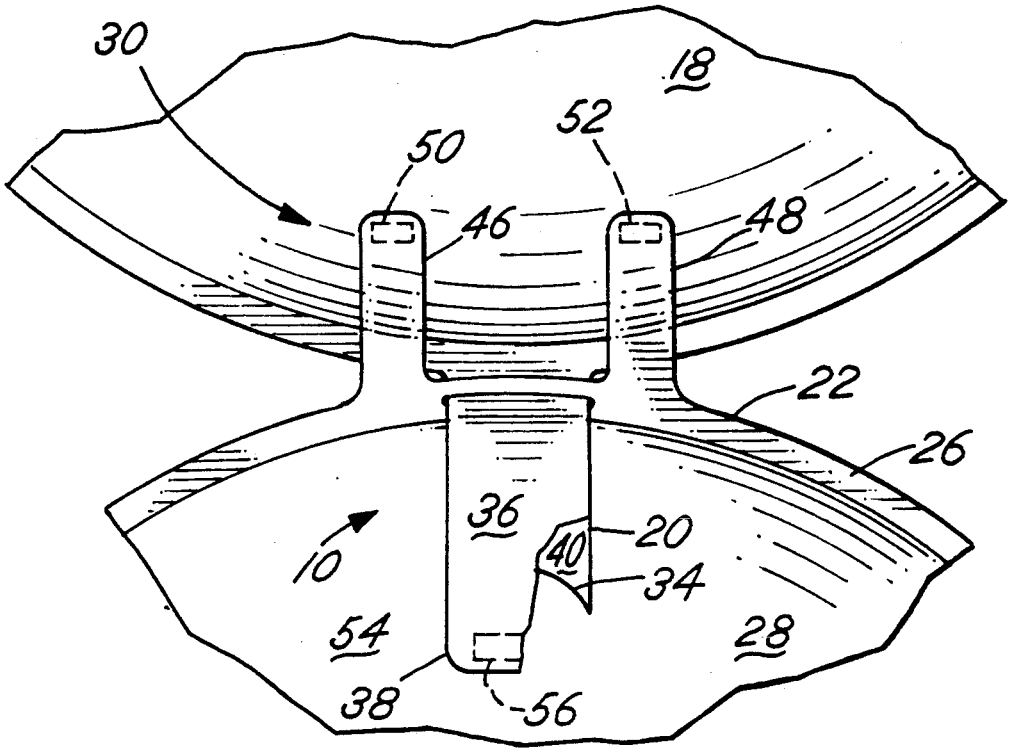
FIG. 4 is an enlarged partial back, partial cut-away view of a second preferred embodiment of the present invention.

A second preferred embodiment of the present invention is shown in FIG. 4. The second balloon 14 is provided with a pair of placement tabs 46, 48. The tabs 46, 48 are substantially rectangular and extend from the boundary enlargement 22 at points substantially adjacent to slot 24.

Prior to inflation of the first balloon 12, but subsequent to engagement of the stem 20 with the slot 24, the placement tabs 46, 48 are secured to the body 18 of the first balloon 12 by the securement means 30. The securement means 30 includes double-sided tape segments 50, 52 (shown in phantom in FIG. 4) attached to the tabs 46, 48, respectively. If the inflatable toy product is factory-assembled, the tape segments 50, 52 need not include removable protective sheets.

In this embodiment, the inflation aperture 32 is defined by semicircular punch 34 in the front balloon web 40 of the first balloon 12. The end 38 of the stem 20 is secured to the back web 54 of the second balloon 14 by the securement means 30, again "hiding" the inflation aperture 32. The securement means 30 includes a segment of double-sided tape 56 (partially shown in phantom in FIG. 4), positioned on the balloon web 36 at the end 38 of the stem 20.

The tabs 46, 48 are shown as adhered to the back web 36 of the balloon 12. Alternatively, the tabs 46, 48 may be adhered to the front web 40.

Figure 5:
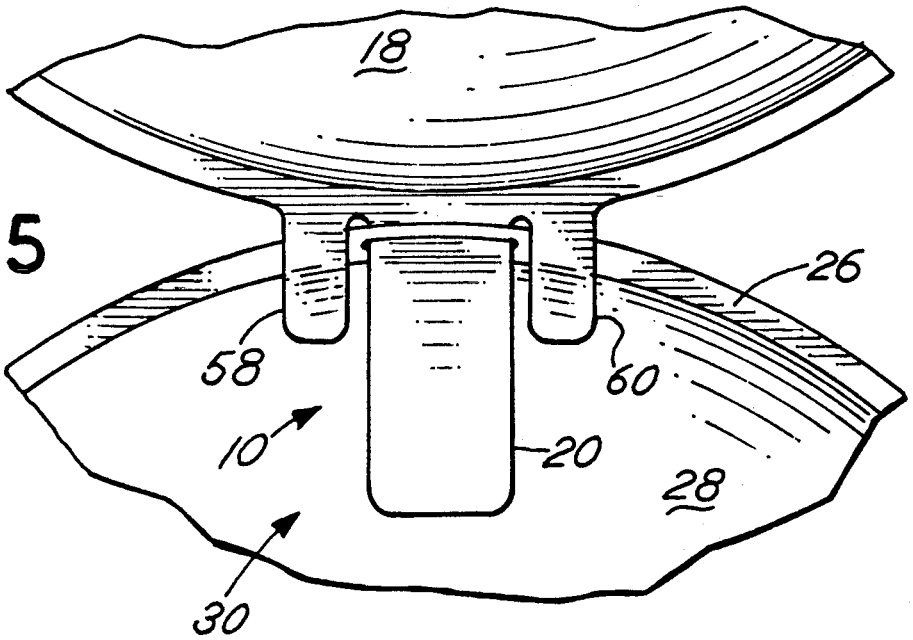
FIG. 5 is an enlarged partial back view of a third preferred embodiment.

A third preferred embodiment is shown in FIG. 5. A pair of placement tabs 58, 60 extend from the first balloon 12. The tabs 58, 60 extend substantially parallel to the stem 20 and are adhered by the securement means 30 to either web of the second balloon 14.

With respect to the embodiments shown in FIGS. 4 and 5, the stem 20 is preferably fed through the slot 24 and the placement tabs 46, 48 or 58, 60 are adhered prior to inflation. The first balloon 12 is inflated and the stem 20 is adhered, securing the stem slot engagement and the interlocking of the balloons 12, 14. The second balloon 14 is then inflated, completing the process.

The placement tabs 46, 48 or 58, 60 add rigidity which may be desired in certain toy products, particularly those including large balloons, and may be included with the preferred embodiment shown in FIGS. 1-3. The securement means 30 and the tabs 46, 48 or 58, 60 thus cooperate to define alignment means, generally designated 62, to stabilize the upper balloon 12 with respect to the lower balloon 14 and to substantially avoid skewing.

Various preferred embodiments of the present invention have been described. It is to be understood, however, that changes and modifications can be made without departing from the true scope and spirit of the present invention as defined by the following claims, which are to be interpreted in view of the foregoing.

What is claimed is:

1. Interlock means for attaching a first non-latex balloon having a body to a second non-latex balloon having a boundary comprising, in combination:

a stem extending from said body of said first non-latex balloon;

a slot defined by said boundary of said second non-latex balloon to engagingly receive said stem and to establish a predetermined orientation between said first and second non-latex balloon;

at least one placement tab extending between said first and second non-latex balloons and secured thereto; and securement means for securing engagement of said stem and said slot by securement of said stem to one of said first and second non-latex balloons, whereby said first non-latex balloon and said second non-latex balloon are interlocked.

2. Interlock means as claimed in claim 1 wherein said stem of said first non-latex balloon defines an inflation passageway.

3. Interlock means as claimed in claim 1 or 2 wherein said stem is folded over to contact said body of said first non-latex balloon.

4. Interlock means as claimed in claim 3 wherein said securement means secures said stem to said body of said first non-latex balloon.

5. Interlock means as claimed in claim 4 wherein said securement means is a segment of double-sided tape having a removable protective sheet.

6. Interlock means as claimed in claim 5 wherein said double-sided tape is positioned on said stem.

7. Interlock means as claimed in claim 1 or 2 wherein said securement means secures said stem to said second non-latex balloon.

8. Interlock means as claimed in claim 7 wherein said securement means is a segment of double-sided tape.

9. Interlock means as claimed in claim 1 wherein said placement tab extends integrally from said second non-latex balloon.

10. Interlock means as claimed in claim 9 wherein said securement means secures said stem and said placement tab to said first non-latex balloon.

11. Interlock means as claimed in claim 9 wherein said securement means secures said stem to said second non-latex balloon and said placement tab to said first non-latex balloon.

12. Interlock means as claimed in claim 1 wherein said placement tab extends integrally from said body of said first non-latex balloon.

13. Interlock means as claimed in claim 12 wherein said securement means secures said stem and said placement tab to said second non-latex balloon.

14. Interlock means as claimed in claim 12 wherein said securement means secures said stem to said body of said first non-latex balloon and said placement tab to said second non-latex balloon.

15. An inflatable product including a first non-latex balloon having a body and a second non-latex balloon having a boundary produced by a process comprising the steps of:

providing a stem extending from said body;

providing a slot in said boundary;

engaging said slot with said stem;

securing said stem to secure engagement of said slot and said stem, whereby said first and second non-latex balloons are interlocked; and providing at least one placement tab extending between said first and second non-latex balloons and further securing said first non-latex balloon with respect to said second non-latex balloon.

16. An inflatable product as claimed in claim 15 further comprising the step of inflating said first non-latex balloon prior to securing said stem.

17. An inflatable product as claimed in claim 16 further comprising the step of inflating said second non-latex balloon after securing said stem.

18. An inflatable product as claimed in claim 15 or 16 wherein said securing step includes folding said stem into contact with said body of said first non-latex balloon and securing said stem thereto.

19. An inflatable product as claimed in claim 15 further comprising the step of positioning an adhesive on said stem prior to securing said stem.

20. An inflatable product as claimed in claim 19 wherein said adhesive is a segment of double-sided tape.

21. An inflatable product as claimed in claim 19 wherein said securing step includes folding said stem into contact with said body of said first non-latex balloon and securing said stem thereto with said adhesive.

22. An inflatable product as claimed in claim 15 or 16 wherein said securing step includes contacting said second non-latex balloon with said stem and securing said stem thereto.

23. An inflatable product as claimed in claim 19 wherein said securing step includes contacting said second non-latex balloon with said stem and securing said stem thereto with said adhesive.

24. A method for attaching a first non-latex balloon having a body to a second non-latex balloon having a boundary comprising the steps of:

providing said first non-latex balloon with a stem extending from said body;

providing said second non-latex balloon with a slot within said boundary;

engaging said slot with said stem;

securing said stem to one of said first non-latex balloon and said second non-latex balloon to secure engagement of said slot and said stem, whereby said first and second non-latex balloons are joined; and providing at least one placement tab extending between said first and second non-latex balloons and further securing said first non-latex balloon with respect to said second non-latex balloon.

25. A method as claimed in claim 24 wherein said securing step includes folding said stem and securing said stem to said body of said first non-latex balloon.

26. A method as claimed in claim 24 wherein said securing step includes contacting said second non-latex balloon with said stem and securing said stem thereto.

27. A method as claimed in claim 25 or 26 wherein said placement tab extends integrally from said second non-latex balloon and is secured to said body of said first non-latex balloon.

28. A method as claimed in claim 25 or 26 wherein said placement tab extends from said first non-latex balloon and is secured to said second non-latex balloon.

* * * * *